US011795886B2

(12) United States Patent
Marrack et al.

(10) Patent No.: US 11,795,886 B2
(45) Date of Patent: Oct. 24, 2023

(54) REDUCED ENERGY WAVEFORM FOR ENERGIZING SOLENOID ACTUATOR IN FUEL INJECTOR VALVE

(71) Applicant: Caterpillar Inc., Peoria, IL (US)

(72) Inventors: Andrew O. Marrack, Peoria, IL (US); Daniel Reese Puckett, Peoria, IL (US); Mitchell B. Juchems, Tremont, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/549,288

(22) Filed: Dec. 13, 2021

(65) Prior Publication Data

US 2023/0184189 A1 Jun. 15, 2023

(51) Int. Cl.
*F02D 41/20* (2006.01)

(52) U.S. Cl.
CPC ..... *F02D 41/20* (2013.01); *F02D 2041/2034* (2013.01); *F02D 2041/2051* (2013.01); *F02D 2200/0602* (2013.01); *F02D 2200/0606* (2013.01); *F02D 2200/101* (2013.01)

(58) Field of Classification Search
CPC ..... F02D 41/20; F02D 2041/2034; F02D 2041/2051; F02D 2200/0602; F02D 2200/0606; F02D 2200/101
See application file for complete search history.

(56) References Cited

U.S. PATENT DOCUMENTS

| | | | | |
|---|---|---|---|---|
| 5,701,870 | A * | 12/1997 | Gottshall | F02D 41/20 123/490 |
| 6,167,869 | B1 * | 1/2001 | Martin | F02M 57/023 123/506 |
| 6,390,082 | B1 * | 5/2002 | Duffy | F02D 41/402 123/492 |
| 9,127,613 | B2 | 9/2015 | Nonoyama et al. | |
| 9,588,016 | B2 | 3/2017 | Ishizuka et al. | |
| 10,197,001 | B2 | 2/2019 | Ahn et al. | |
| 10,634,083 | B2 | 4/2020 | Kusakabe et al. | |
| 2003/0062029 | A1 * | 4/2003 | Oyama | F02D 41/20 361/152 |
| 2003/0120418 | A1 * | 6/2003 | Treichel | F02D 41/345 123/506 |
| 2009/0132180 | A1 * | 5/2009 | Pearce | F02D 41/20 702/38 |
| 2009/0183714 | A1 * | 7/2009 | Mayuzumi | H02M 1/32 123/490 |
| 2009/0243574 | A1 * | 10/2009 | Mayuzumi | F02D 41/20 323/282 |

(Continued)

*Primary Examiner* — Logan M Kraft
*Assistant Examiner* — Susan E Scharpf
(74) *Attorney, Agent, or Firm* — Brannon Sowers & Cracraft PC

(57) ABSTRACT

Operating an engine system and fuel system includes energizing a solenoid actuator for a spill valve in a fuel injector in a first engine cycle via a standard waveform to inject a shot of fuel. Operating an engine system and fuel system further includes determining suitability for reduced energy operating of the fuel system, and energizing the solenoid actuator via a reduced energy waveform based on the determining suitability so as to inject one or more shots of fuel in a second engine cycle. The operating methodology and control logic can extend an engine speed range for multi-shot fuel injection in an engine.

14 Claims, 5 Drawing Sheets

(56) References Cited

U.S. PATENT DOCUMENTS

| | | | | |
|---|---|---|---|---|
| 2010/0263632 | A1* | 10/2010 | Miyake | F02D 41/20 123/476 |
| 2012/0067329 | A1* | 3/2012 | Bunni | F02D 41/20 123/490 |
| 2014/0069389 | A1* | 3/2014 | Nishimura | F02D 41/30 123/478 |
| 2017/0191437 | A1* | 7/2017 | Yanoto | F02D 41/20 |
| 2017/0226950 | A1* | 8/2017 | Tanaka | F02D 41/2467 |
| 2018/0010547 | A1* | 1/2018 | Itaya | F02D 41/3023 |
| 2019/0211767 | A1* | 7/2019 | Miyake | F02D 41/20 |
| 2020/0157980 | A1 | 5/2020 | Niwa et al. | |
| 2021/0140386 | A1* | 5/2021 | Puckett | F02M 63/0015 |

* cited by examiner

REDUCED ENERGY WAVEFORM FOR ENERGIZING SOLENOID ACTUATOR IN FUEL INJECTOR VALVE

TECHNICAL FIELD

The present disclosure relates generally to energizing a solenoid actuator for a valve of a fuel injector, and more particularly to energizing a solenoid actuator by way of a reduced energy waveform.

BACKGROUND

Modern internal combustion engines utilize a range of operating and logic strategies for associated fuel systems. In a typical fuel system configuration a plurality of fuel injectors are each associated with one of a plurality of combustion cylinders in an engine. The fuel injectors are electronically controlled and receive electrical control current signals from an engine control system. The electrical control currents cause energizing of solenoids or other electrical actuators in or associated with the fuel injectors to adjust valves that determine the timing and manner of injection of fuel and sometimes fuel pressurization.

One known fuel system configuration applied extensively to compression-ignition diesel engines employs a direct operated nozzle check that can be opened and closed to start and end injection of fuel based on a closing hydraulic pressure that is applied to a surface of the check. A spill valve in the fuel injector controls fluid connection between a plunger cavity and a low pressure space. When the spill valve is open a plunger in the fuel injector can reciprocate passively to exchange fuel between the plunger cavity and low pressure space. When the spill valve is closed the plunger pressurizes fuel in the fuel injector to an injection pressure, with the timing of fuel injection controlled by way of the direct operated check as stated above.

Engineers have experimented for decades with the manner in which electrical actuators for such spill valves and direct operated checks can be energized and deenergized to various ends. In some instances the spill valve is closed to start building pressure in the fuel injector, the check operated to perform a single shot fuel injection, and the spill valve opened. In other instances the spill valve can be closed and opened multiple times during an engine cycle to enable multiple fuel pressurization events during a single plunger stroke, which are exploited to inject multiple shots of fuel. There can be advantages to employing multiple shots of fuel in certain instances. Certain engine operating conditions, however, can make injection of multiple shots of fuel in a single engine cycle challenging. United States Patent Application Publication No. US20210140386A1 shows a typical spill valve fuel injector arrangement.

SUMMARY

In one aspect, a method of operating a fuel system for an engine system includes energizing a solenoid actuator for a valve of a fuel injector in a first engine cycle of an engine via a standard waveform, and injecting a shot of fuel in the first engine cycle based on the energizing a solenoid actuator via a standard waveform. The method further includes determining suitability for reduced energy operating of the fuel system, and energizing the solenoid actuator in a second engine cycle of the engine via a reduced energy waveform based on the determining suitability of the engine system for reduced energy operating of the fuel system. The method further includes injecting a shot of fuel in the second engine cycle based on the energizing a solenoid actuator via a reduced energy waveform.

In another aspect, a fuel system for an engine includes a fueling control unit having an energizing waveform controller structured to energize a solenoid actuator via a standard waveform to actuate a valve in a fuel injector in a first engine cycle. The energizing waveform controller is further structured to energize the solenoid actuator via a reduced energy waveform to actuate the valve in a second engine cycle, and to switch from a higher voltage power supply to a lower voltage power supply during the energizing of the solenoid actuator in a second engine cycle.

In still another aspect, a method of extending an engine speed range for multi-shot fuel injection in an engine includes actuating a valve of a fuel injector for the engine a plurality of times in an engine cycle, and injecting a plurality of shots of fuel into a combustion cylinder of the engine in the engine cycle based on the actuating a valve a plurality of times. The method further includes energizing a solenoid actuator of the valve via a reduced energy waveform to cause at least one of the actuations of the valve.

DETAILED DESCRIPTION

Figure 1:
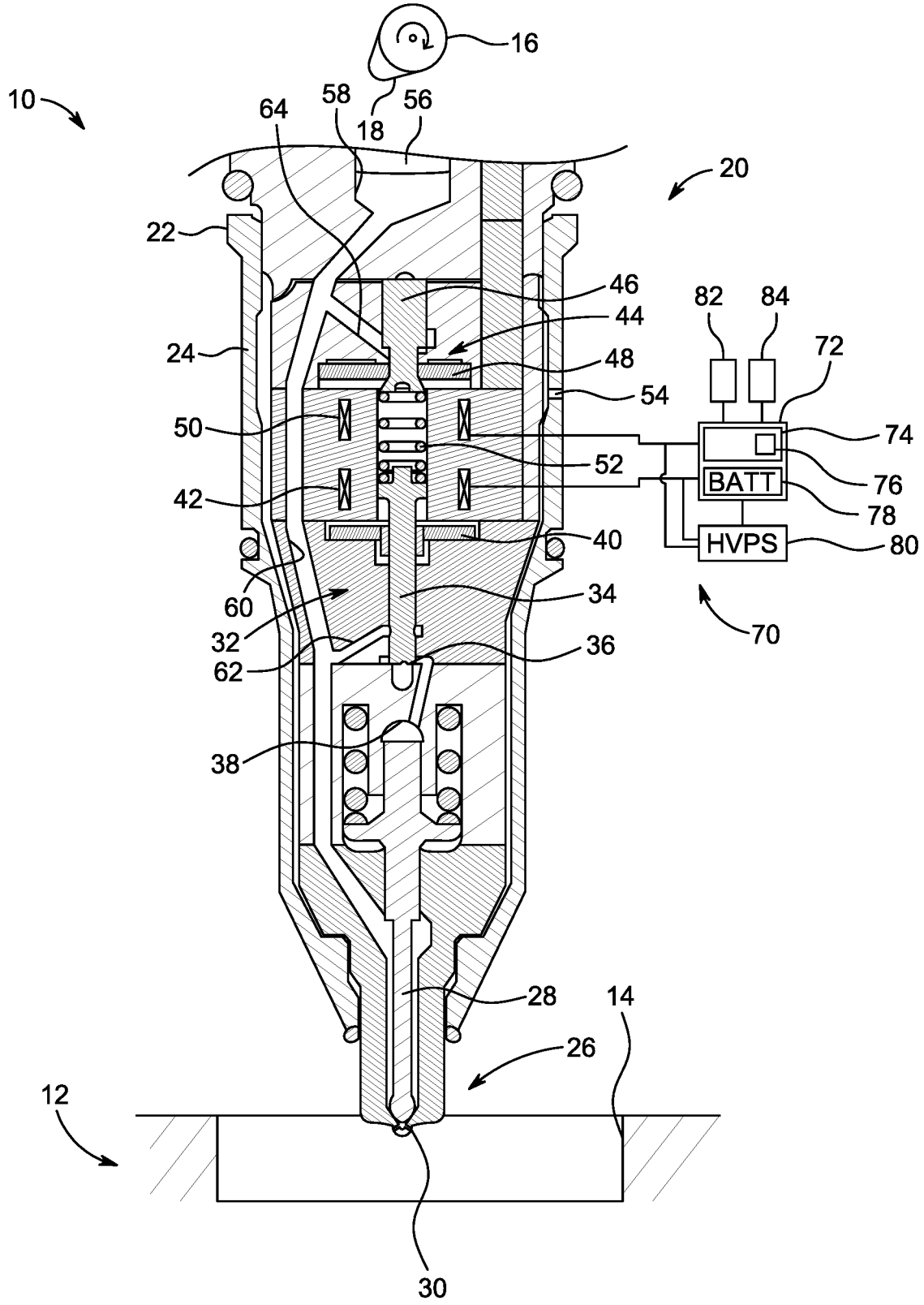
FIG. 1 is a sectioned diagrammatic view of an internal combustion engine system, according to one embodiment.

Referring to FIG. 1, there is shown an internal combustion engine system 10, according to one embodiment. Engine system 10 includes an internal combustion engine 12 having a combustion cylinder 14 formed therein. Combustion cylinder 14 may be one of any number of combustion cylinders in engine 12 in any suitable arrangement such as an in-line pattern, a V-pattern, or still another. Engine 12 will typically be equipped with an intake system, an exhaust system, engine valves, and various other apparatus not explicitly shown. A piston will be movable in combustion cylinder 14 between a top dead center position and a bottom dead center position, typically in a conventional four-cycle pattern. Engine 12 may be compression-ignited and operated on a suitable compression-ignition fuel such as a diesel distillate fuel although the present disclosure is not limited as such. Engine 12 may also include a rotatable crankshaft (not shown) coupled by way of a geartrain with a rotatable camshaft 16 having a cam lobe 18. Camshaft 16 will typically include a plurality of cam lobes arranged to operate equipment including fuel injectors in engine system 10, as further discussed herein.

Engine system 10 further includes a fuel system 20. Fuel system 20 will typically include a plurality of fuel injectors each positioned to extend partially into one of a plurality of combustion cylinders in engine 12. In FIG. 1 one fuel injector 22 is shown associated with combustion cylinder 14, and it will be appreciated that description and discussion of fuel injector 22 should be understood by way of analogy to refer to any other fuel injectors of fuel system 20. Fuel injector 22 includes an injector housing 24 having a nozzle 26 that extends into combustion cylinder 14. A plurality of nozzle outlets 30 are formed in nozzle 26 and fluidly communicate with combustion cylinder 14. Fuel injector 22 also includes a direct operated check or DOC 28 movable in injector housing 24 to open and close nozzle outlets 30 to directly inject a liquid fuel, such as diesel distillate fuel, into combustion cylinder 14. DOC 28 is directly hydraulically operated on the basis of a fluid pressure, typically a fluid pressure of fuel, in a pressure control chamber 38.

Fuel injector 22 also includes an injection control valve assembly 32. Injection control valve assembly 32 is operable to control a closing hydraulic pressure in pressure control chamber 38 to enable opening and closing of DOC 28. Injection control valve assembly 32 includes an injection control valve 34 movable to open and close a valve seat 36. When valve seat 36 is opened pressure control chamber 38 can fluidly connect to a low pressure space 54 defined by injector housing 24 enabling DOC 28 to open and permit spraying of fuel from nozzle outlets 30. When valve seat 36 is closed an increased hydraulic pressure is seen in pressure control chamber 38 and causes DOC 28 to close. An armature 40 is coupled with injection control valve 34. Armature 40 is associated with a solenoid actuator 42 that can be energized to magnetically attract armature 40 and open valve seat 36. When solenoid actuator 42 is deenergized a biasing spring 52 urges injection control valve 34 closed against valve seat 36.

Fuel injector 22 also includes a spill valve assembly 44. Spill valve assembly 44 includes a spill valve 46 coupled with an armature 48 and a solenoid actuator 50. When solenoid actuator 50 is energized armature 48 is magnetically attracted toward solenoid actuator 50. When solenoid actuator 50 is deenergized biasing spring 52 urges armature 48 and spill valve 46 away from solenoid actuator 50. Fuel injector 22 also includes a plunger 46 movable in a plunger cavity 58. In an implementation plunger 56 is mechanically cam-actuated by way of rotation of camshaft 16, in a generally known manner. When spill valve 46 is open, upward movement of plunger 56 causes fuel to be drawn into plunger cavity 58 such as by way of a spill passage 64 from low pressure space 54. Downward movement of plunger 56 causes the fuel to be discharged from plunger cavity 58 through spill passage 64 and back to low pressure space 54. When spill valve 46 is closed fluid communication between plunger cavity 58 and low pressure space 54 is blocked and advancement of plunger 56 causes fuel pressure in plunger cavity 58 to increase. The increased fuel pressure is communicated by way of a nozzle supply passage 60 to the vicinity of nozzle outlets 30. When DOC 28 is lifted, at a desirable timing, fuel sprays from nozzle supply passage 60 out of nozzle outlets 30. Another fluid passage 62 fluidly connects between nozzle supply passage 60 and injection control valve 34. In the illustrated embodiment spill valve assembly 44 is resident in fuel injector 22. In other embodiments a spill valve assembly could be positioned externally to fuel injector 22. Also in the illustrated embodiment the hydraulic control fluid used for direct control of DOC 28 is fuel. In other instances a different fluid, such as engine oil, could be used for direct control of a nozzle outlet check. Plunger 56 may be equipped with a tappet contacted by cam lobe 18. In other instances, a rocker arm actuation assembly could be interposed plunger 56 and camshaft 16.

Fuel system 20 also includes a fuel control system 70. Fuel control system 70 includes an electronic control module or ECM 72 having thereon an electronic control unit or ECU 74. ECU 74 can be, or can include, a programmable logic controller such as a microprocessor or microcontroller and suitable computer readable memory storing program control instructions which, when executed by a processor, cause fuel injector 22 to operate according to the present disclosure. Any suitable computer readable memory such as RAM, ROM, EPROM, DRAM, SDRAM, FLASH, or still another could be used. Fuel control system 70 also includes a lower voltage power supply such as a battery 78, and a boosted, higher voltage power supply 80. Battery 78 is shown as part of ECM 72 but could be a separate apparatus in other embodiments. Higher voltage power supply or HVPS 80 is shown physically separated from ECM 72 but could also be a part of ECM 72 in some embodiments. Fuel control system 70 also includes an engine speed sensor 82 and a fuel temperature sensor 84. As will be further apparent from the following description, fuel control system 70 is uniquely configured to operate fuel injector 22, and other such fuel injectors as might be included in fuel system 20, in a multi-shot fuel injection mode under different or broader engine operating conditions than is the case with certain other known control system arrangements. Moreover, as also further discussed herein, fuel control system 70 is capable of operating fuel injector 22, and other such fuel injectors as might be included in fuel system 20, in a relatively reduced energy or reduced power consumption mode.

In certain instances, a higher voltage power supply of or controlled by an ECM has a maximum power output that cannot be exceeded. As engine speed of an engine increases it is commonly necessary to increase an amount of fuel injected in a given engine cycle and potentially increase an amount of fuel injected per unit time. While an engine can be operated with various combinations and/or patterns of shot number, timing, and shot amount over part of an operating range, such as at lower engine speeds, it can desirable but challenging to utilize multi-shot injections or other variations in other parts of an engine operating range, such as at higher engine speeds. Put differently, at higher engine speeds it can be desirable to use multiple shots of fuel to deliver a desired fueling amount, but the capability to deliver multiple shots of fuel can be limited based on the power supply capabilities of the ECM. A pressure rise rate of fuel will typically also need to be relatively higher if all fuel needs to go in to a combustion cylinder in a single shot. A lack of multi-shot injection capabilities can have a detrimental effect respecting increased noise, vibration, harshness, smoke opacity, cold mode or cold start conditions, transient operating conditions of the engine, or other operating characteristics or states. The present disclosure provides solutions to these and other challenges.

To this end, fueling control unit or ECU 74 may include an energizing waveform controller 76. Energizing waveform controller 76 can include any combination of software, firmware, or hardware including circuitry, of electronic control unit 74, and is structured to energize a solenoid actuator of a fuel injector according to multiple different waveforms. In particular, energizing waveform controller 76 is structured to energize a solenoid actuator, such as one or both of solenoid actuators 50 and 42, via standard waveforms to actuate a valve such as injection control valve 34 or spill valve 46, in fuel injector 22. Energizing waveform controller 86 may be further structured to energize one or both of the subject solenoid actuators via a reduced energy waveform to actuate the subject valves.

Energizing waveform controller 76 is also structured to switch from a higher voltage power supply such as HVPS 80 to a lower voltage power supply such as battery 78, during the energizing of the subject solenoid actuator. In some embodiments, energizing waveform controller 76 energizes solenoid actuator 50 via a standard waveform to actuate spill valve 46 one or more times in a first engine cycle, and energizes solenoid actuator 50 via a reduced energy waveform to actuate spill valve 46 one or more times in a second engine cycle. Within a given engine cycle energizing waveform controller 76 may energize solenoid actuator 50 multiple times, potentially using a standard waveform for one or more of the energizations and a reduced energy waveform for one or more of the energizations. Part of the reduced energy waveform can be produced by power from HVPS 80 and part produced by power from battery 78, as further discussed herein.

Figure 2:
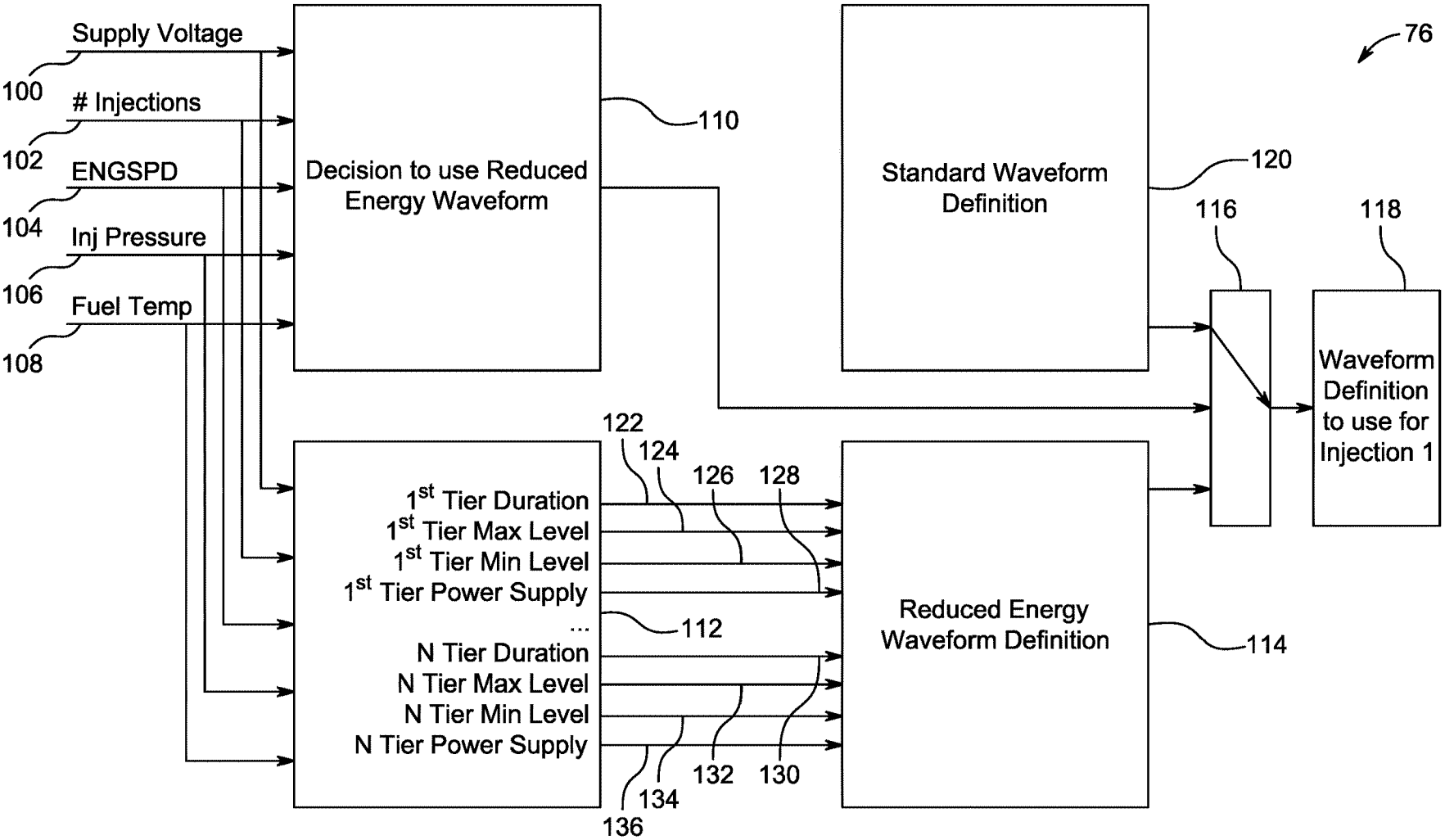
FIG. 2 is a functional block diagram of an energizing waveform controller, according to one embodiment.

Referring also now to FIG. 2, there are shown features and functionality of energizing waveform controller 76 in a functional block diagram in further detail. Energizing waveform controller 76 may be understood to have multiple different control blocks, including a decision block 110 that performs a decision to use or not use a reduced energy waveform. A standard waveform definition is shown at a block 120, and a reduced energy waveform definition is shown at a block 114. Blocks 120 and 114 are understood to specify factors such as amplitude, duration, and power supply to be used for, or for part of, electrical control currents produced according to the respective waveforms for controlling a valve such as spill valve 46 in fuel injector 22. Parameters of individual injections or shots of fuel are shown at a block 112 and as inputs to block 114. At a switching block 116 a standard waveform definition, a reduced energy waveform decision, and a reduced energy waveform definition may be applied as appropriate to produce a waveform definition to use for an injection or shot of fuel at a block 118. Inputs to decision block 110 can include a supply voltage 100, for example an available battery supply voltage, a number of injections 102, an engine speed 104, an injection pressure to be delivered 106, and a present fuel temperature 108. These same inputs 100, 102, 104, 106, 108, can be fed to block 112. It will be appreciated that at block 112 the various inputs can be processed to determine parameters of solenoid energization using a reduced energy waveform. Such parameters can include a first tier duration 122, a first tier max level 124, a first tier min level 126, and a first tier power supply 128, e.g. boosted versus battery. The parameters can also include an N tier duration 130, an N tier max level 132, an N tier min level 134, and an N tier power supply 136. The parameters at block 112 can thus be understood as the parameters of a first shot, and the analogous parameters of additional "N" numbers of shots. ECM 72 can thus use a reduced energy waveform versus a normal waveform for any combination of shots 1 through N and provides a continuously variable waveform shape for the reduced energy waveform. The reduced energy waveform is determined according to block 114, and can then be used in the waveform definition for a given injection as in block 118.

Decision block 110 performs a decision to use or not use a reduced energy waveform as noted above. In some instances, energizing waveform controller 76 is understood to determine suitability of engine system 10 for reduced energy operating of fuel system 22. This means that, at times, engine system 10 may not be suited or appropriate for multi-shot injection or another scenario where a reduced energy waveform might be used. In other instances, engine system 10 can be suited or appropriate for using the reduced energy waveform. For example, a fuel temperature that is relatively low could be associated with a higher fuel viscosity that makes injecting sufficient fuel in several smaller shots versus one larger shot impracticable. Engine speed could also exceed a speed at which there is sufficient time to inject several smaller shots versus one larger shot. Various other combinations of parameters listed, or still other parameters, might justify selection of a standard energy waveform, a reduced energy waveform, or combinations thereof. In any instance, solenoid actuators in fuel injector 22 may be operated with a reduced energy waveform to inject at least one shot of fuel where suitability of engine system 10 for reduced energy operating of fuel system 20 is determined.

Figure 3:
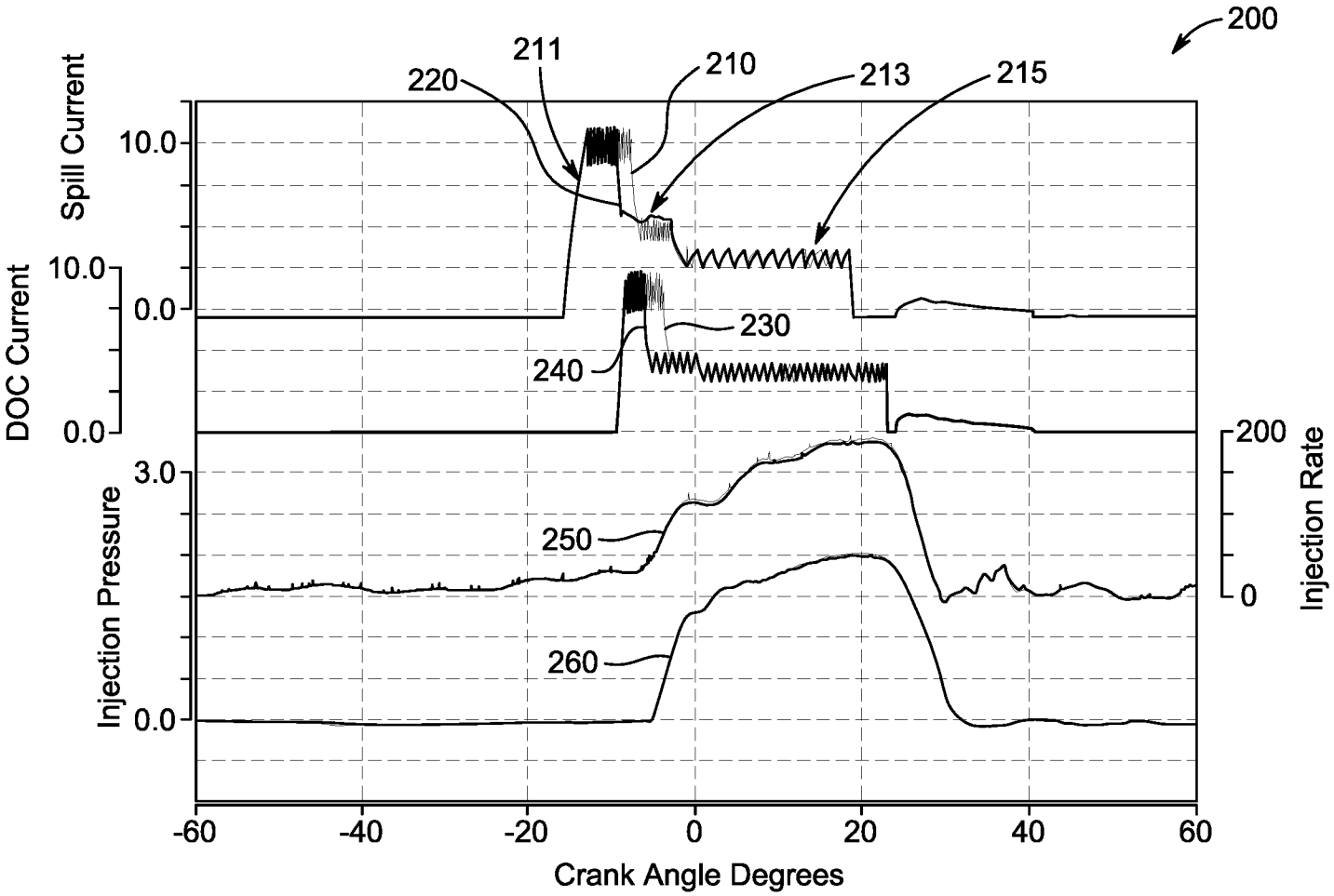
FIG. 3 is a graph of solenoid energization and fuel injector operation, according to one embodiment.

Referring also now to FIG. 3, there is shown a graph 200 illustrating example control current features comparing a standard waveform to a reduced energy waveform. In FIG. 3, a standard waveform spill valve current is shown at 210, in comparison to a reduced energy waveform spill valve current at 220. Injection pressure is shown at trace 250 and injection rate is shown at a trace 260. Standard waveform current 210 includes a pull-in current 211 that initially pulls in spill valve 46, a keep-in current 213, and a hold-in current 215. Using the standard waveform, pull-in current 211 may be produced using HVPS 80, keep-in current 213 may likewise be produced using HVPS, and hold-in current 215 produced using battery 78. Using the reduced energy waveform 220 a pull-in current can be produced using HVPS 80, a keep-in current produced using battery 78, and a hold-in current produced using battery 78. It can thus be appreciated by way of the comparison shown in FIG. 3 that the standard waveform employs the higher voltage power supply for pull-in current 211 and also for keep-in current 213.

In the illustrated example, each of the standard waveform and the reduced energy waveform are defined by a pull-in current having a greater amplitude, a keep-in current of a medium amplitude, and a hold-in current having a lesser amplitude. The pull-in current of the reduced energy waveform is produced using a higher voltage power supply, however, in contrast to the standard waveform the keep-in current of the reduced energy waveform is produced using the lower voltage power supply. The pull-in current of the standard waveform has a relatively longer duration and the pull-in current of the reduced energy waveform has a relatively shorter duration. This strategy enables energy savings employing the reduced energy waveform. Also shown in FIG. 3 is a standard waveform 230 used for a DOC current in comparison to a reduced energy waveform 240 used for a DOC current. Principles analogous to those described in connection with energizing a spill valve solenoid actuator can be applied to energizing a DOC solenoid actuator.

Figure 4:
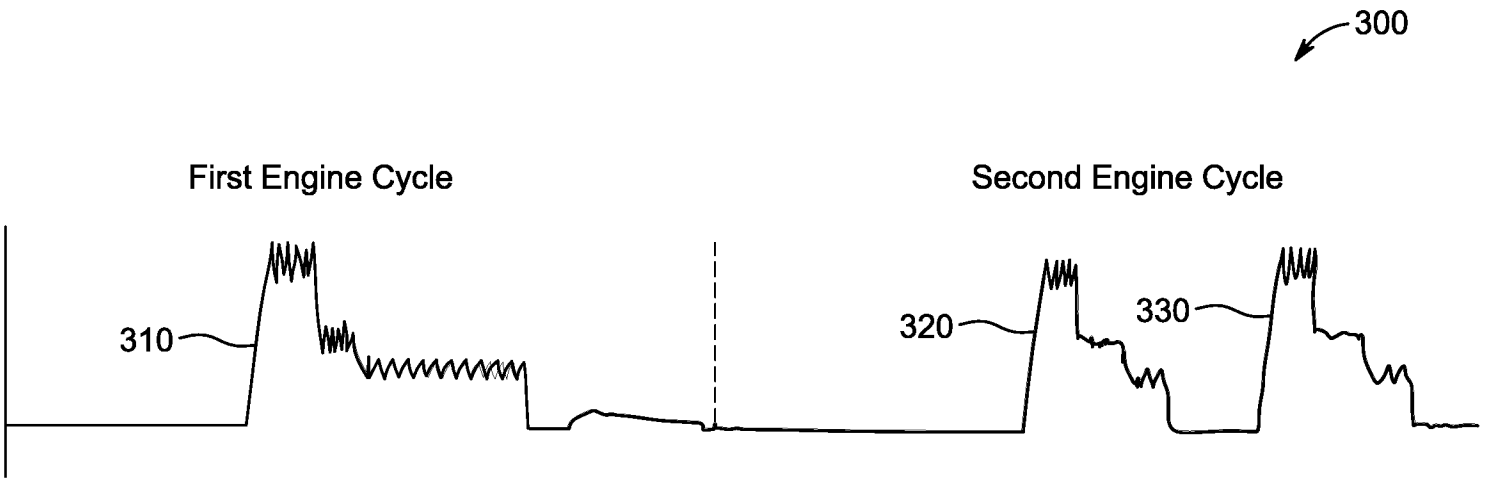
FIG. 4 is a diagram illustrating example energizing waveforms for a solenoid actuator in two engine cycles, according to one embodiment.

Referring now to FIG. 4, there are shown features of a standard waveform for a spill current used to inject one shot of fuel in a first engine cycle at 310, and reduced energy waveforms 320 and 330 used to inject multiple shots of fuel in a second engine cycle. It can be noted from FIG. 4 that trace 310 is relatively longer in duration and includes a longer duration pull-in current. Traces 320 and 330 are shorter in duration and each includes a relatively shorter duration pull-in current. The same, or a different, total volume of fuel can be injected in the single shot of the first engine cycle versus the two shots of fuel in the second engine cycle.

It should be appreciated, however, that various modifications and extensions to the scenario depicted in FIG. 4 are contemplated. As depicted, in the second engine cycle a reduced energy waveform is used to energize the solenoid actuator each of a first time and a second time in the second engine cycle to inject a first shot and a second shot of fuel.

Alternatively, in the second engine cycle a reduced energy waveform could be used to energize the solenoid actuator a first time to actuate the associated valve to inject a first shot of fuel in the second engine cycle and energized a second time using the standard waveform to actuate the valve to inject a second shot of fuel in the second engine cycle. Further still, shot quantity might be varied amongst the shots in a given engine cycle. Two, three, or more shots of fuel could be injected in a given engine cycle each with the same or with different injection quantities. A reduced energy waveform could be used for a single shot injection of fuel in an engine cycle as well.

INDUSTRIAL APPLICABILITY

Figure 5:
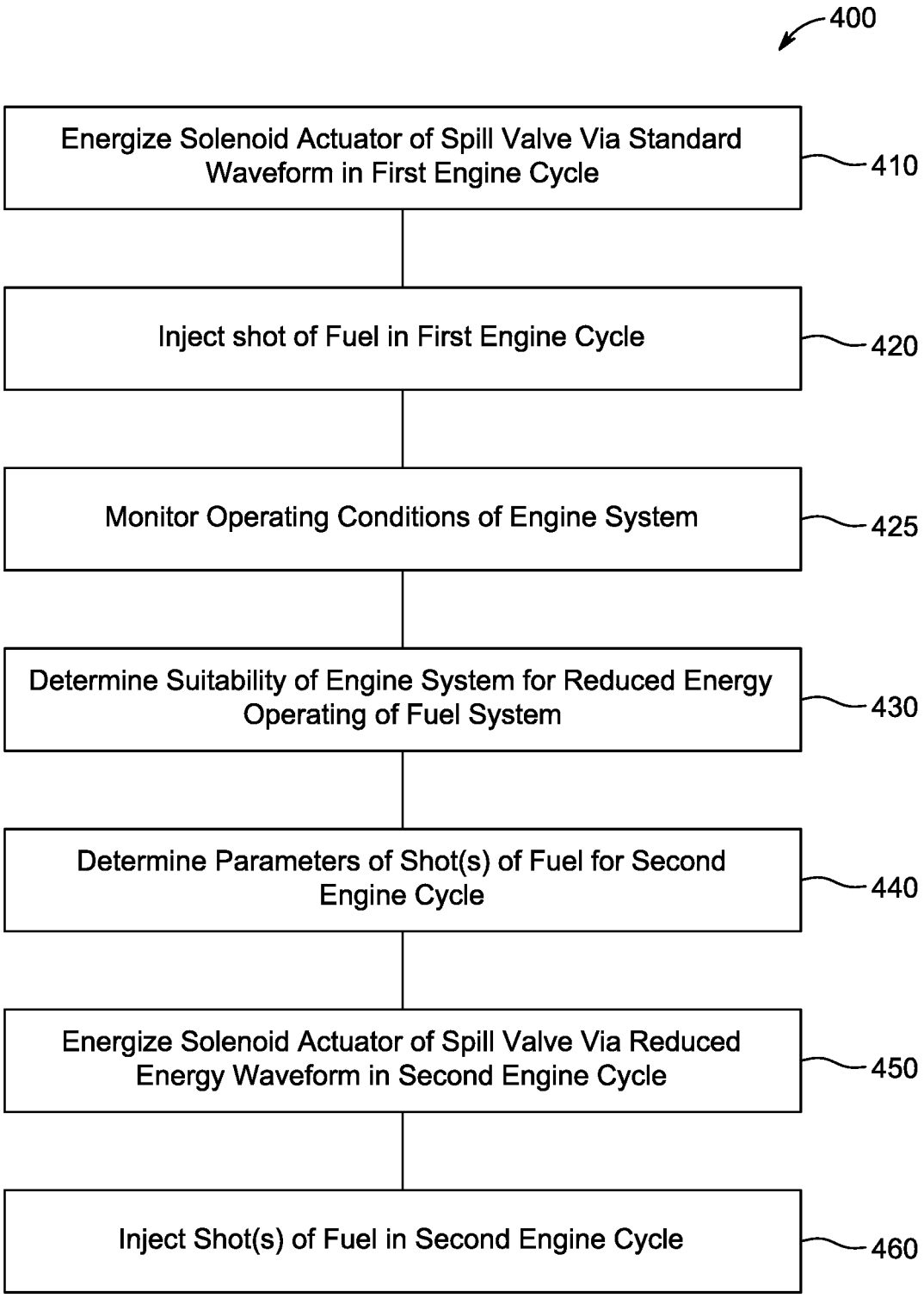
FIG. 5 is a flowchart illustrating example methodology and logic flow, according to one embodiment.

Referring to the drawings generally, but focusing now on FIG. 5, there is shown a flowchart 400 illustrating example methodology and logic flow, according to one embodiment. At a block 410 a solenoid actuator of a spill valve is energized via a standard waveform in a first engine cycle. From block 410 flowchart 400 advances to a block 420 to inject a shot of fuel in the first engine cycle based on energizing a solenoid actuator via a standard waveform as in block 410. From block 420 flowchart 400 advances to a block 425 to monitor operating conditions of an engine system. It will be recalled that monitoring operating conditions of an engine system as in block 425 can include monitoring parameters such as engine speed and fuel temperature. From block 425 flowchart 400 advances to a block 430 to determine suitability of the engine system for reduced energy operating of a fuel system. From block 430 flowchart 400 advances to a block 440 to determine parameters of one or more shots of fuel for a second engine cycle. From block 440 flowchart 400 advances to a block 450 to energize the solenoid actuator of the spill valve via a reduced energy waveform in a second engine cycle. It will be appreciated that block 450 could be executed multiple times corresponding to multiple energizations of the solenoid actuator using the reduced energy waveform. It should also be appreciated that in a second engine cycle the solenoid actuator of the spill valve could be energized using the reduced energy waveform and also energized using a standard energy waveform. Put differently, among multiple shots in an engine cycle the standard energy waveform and the reduced energy waveform could each be used. From block 450 flowchart 400 advances to a block 460 to inject one or more shots of fuel in the second engine cycle.

From the foregoing description it will be appreciated that a valve in a fuel injector may be actuated a plurality of times in an engine cycle, and a plurality of shots of fuel injected into a combustion cylinder in the engine based on the plurality of actuations of the valve. The solenoid actuator for the valve can be energized using a reduced energy waveform to cause at least one of the plurality of actuations of the valve. By using the reduced energy waveform the power output capabilities of an ECM are not exceeded or otherwise limited. As noted above it can be challenging or impossible to employ multiple shot operation above a certain engine speed in certain known systems. Accordingly, by using a reduced energy waveform as described herein the engine speed range in which multi-shot fuel injection can be used can be extended.

The present description is for illustrative purposes only, and should not be construed to narrow the breadth of the present disclosure in any way. Thus, those skilled in the art will appreciate that various modifications might be made to the presently disclosed embodiments without departing from the fall and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of operating a fuel system for an engine comprising:

energizing a solenoid actuator for a valve of a fuel injector in a first engine cycle of an engine via a standard waveform;

injecting a shot of fuel in the first engine cycle based on the energizing a solenoid actuator via a standard waveform;

determining suitability for reduced energy operating of the fuel system;

energizing the solenoid actuator in a second engine cycle of the engine via a reduced energy waveform based on the determining suitability for reduced energy operating of the fuel system;

injecting a shot of fuel in the second engine cycle based on the energizing a solenoid actuator via a reduced energy waveform; and the standard waveform is defined in part by a first power supply parameter indicative of a first power supply used in producing the standard waveform, and the reduced energy waveform is defined in part by a second power supply parameter different from the first power supply parameter and used in producing the reduced energy waveform.

2. The method of claim 1 wherein the determining suitability includes determining suitability for reduced energy actuation of the valve of the fuel injector.

3. The method of claim 2 wherein the shot of fuel injected in the second engine cycle is one of a plurality of shots of fuel injected in the second engine cycle.

4. The method of claim 3 wherein the solenoid actuator includes a solenoid actuator of a spill valve.

5. The method of claim 2 wherein the determining suitability is based on an engine speed.

6. The method of claim 5 wherein the determining suitability is based on a supply voltage, a fuel shot number, an injection pressure, and a fuel temperature.

7. A method of operating a fuel system for an engine comprising:

energizing a solenoid actuator for a valve of a fuel injector in a first engine cycle of an engine via a standard waveform;

injecting a shot of fuel in the first engine cycle based on the energizing a solenoid actuator via a standard waveform;

determining suitability for reduced energy operating of the fuel system;

energizing the solenoid actuator in a second engine cycle of the engine via a reduced energy waveform based on the determining suitability for reduced energy operating of the fuel system; and injecting a shot of fuel in the second engine cycle based on the energizing a solenoid actuator via a reduced energy waveform;

wherein each of the standard waveform and the reduced energy waveform is defined by a pull-in current having a greater amplitude, a keep-in current, and a hold-in current having a lesser amplitude; and wherein the pull-in current and the keep-in current of the standard waveform are produced by a higher voltage power supply, and the keep-in current of the reduced energy waveform is produced by a lower voltage power supply.

8. The method of claim 7 wherein the pull-in current of the standard waveform has a longer duration, and the pull-in current of the reduced energy waveform has a shorter duration.

9. A fuel system for an engine comprising:

a fueling control unit including an energizing waveform controller structured to:

energize a solenoid actuator via a standard waveform to actuate a valve in a fuel injector in a first engine cycle;

determine suitability for reduced energy operating of the fuel system;

energize the solenoid actuator via a reduced energy waveform to actuate the valve in a second engine cycle based on the determined suitability for reduced energy operating of the fuel injector; and switch from a higher voltage power supply to a lower voltage power supply during the energizing of the solenoid actuator in a second engine cycle;

wherein each of the standard waveform and the reduced energy waveform is defined by a pull-in current having a greater amplitude, a keep-in current, and a hold-in current having a lesser amplitude; and wherein the pull-in current and the keep-in current of the standard waveform are produced by the higher voltage power supply, and the keep-in current of the reduced energy waveform is produced by the lower voltage power supply.

10. The fuel system of claim 9 wherein the energizing waveform controller is further structured to switch from the higher voltage power supply producing the pull-in current of the reduced energy waveform to the lower voltage power supply producing the keep-in current of the reduced energy waveform.

11. The fuel system of claim 9 wherein the energizing waveform controller is further structured to:

energize the solenoid actuator a first time via the reduced energy waveform to actuate the valve to inject a first shot of fuel in the second engine cycle; and energize the solenoid actuator a second time during the second engine cycle to actuate the valve to inject a second shot of fuel in the second engine cycle.

12. The fuel system of claim 11 wherein the energizing waveform controller is further structured to energize the solenoid actuator the second time via a reduced energy waveform.

13. The fuel system of claim 9 wherein the energizing waveform controller is further structured to determine the suitability based on an engine speed.

14. The fuel system of claim 9 further comprising a fuel injector, and the valve includes a spill valve of the fuel injector.

* * * * *